US010455864B2

(12) United States Patent
Baker

(10) Patent No.: US 10,455,864 B2
(45) Date of Patent: Oct. 29, 2019

(54) OPEN FRONT PEDICURE SOCK

(71) Applicant: Lawanda Denise Baker, Alabaster, AL (US)

(72) Inventor: Lawanda Denise Baker, Alabaster, AL (US)

(73) Assignee: Lawanda Baker, Alabaster, AL (US)

( * ) Notice: Subject to any disclaimer, the term of this patent is extended or adjusted under 35 U.S.C. 154(b) by 172 days.

(21) Appl. No.: 15/831,218

(22) Filed: Dec. 4, 2017

(65) Prior Publication Data

US 2018/0184724 A1 Jul. 5, 2018

Related U.S. Application Data

(60) Provisional application No. 62/441,624, filed on Jan. 3, 2017.

(51) Int. Cl.

| | |
|---|---|
| ***A41B 11/00*** | (2006.01) |
| ***A41B 11/08*** | (2006.01) |
| ***A41D 13/06*** | (2006.01) |

(52) U.S. Cl.

CPC ..... *A41B 11/004* (2013.01); *A41B 11/08* (2013.01); *A41D 13/06* (2013.01)

(58) Field of Classification Search

CPC ..... A41B 11/004; A41B 11/08; A41D 13/06
See application file for complete search history.

(56) References Cited

U.S. PATENT DOCUMENTS

| | | | | |
|---|---|---|---|---|
| 715,543 | A | 12/1902 | Bosworth | |
| 1,308,483 | A | 7/1919 | Craighead | |
| 1,798,201 | A | 4/1931 | Hedges | |
| 1,999,929 | A | 4/1935 | Hearn | |
| 3,329,972 | A | 7/1967 | Schwab | |
| 4,181,982 | A | 1/1980 | Segovia | |
| 5,054,129 | A | 10/1991 | Baehr | |
| D375,195 | S | 11/1996 | Panassidi | |
| 5,575,013 | A * | 11/1996 | Krack | A41B 11/00 2/239 |
| 5,623,734 | A | 4/1997 | Pugliatti | |
| 5,749,100 | A | 5/1998 | Rosenberg | |
| 5,906,007 | A | 5/1999 | Roberts | |
| 6,704,941 | B1 | 3/2004 | Palm | |
| 7,107,626 | B1 | 9/2006 | Andrews | |
| D752,851 | S * | 4/2016 | Patterson | D2/980 |
| D774,744 | S * | 12/2016 | Williams | D2/980 |
| 10,231,497 | B2 * | 3/2019 | Oh | A41D 19/0006 |
| 2002/0157169 | A1 | 10/2002 | Holloway | |

(Continued)

*Primary Examiner* — Kristen Matter

(57) ABSTRACT

A pedicure sock for use following a pedicure, during and/or after toe nails are painted, to keep the feet warm without disturbing the toenail area includes a full front opening, full front closure, a split central sock body that forms an elongated, hollow member when closed, an open toe area integral with the distal end of the central sock body, and a heel section integral with the proximal end of the central sock body. The open toe section is defined by a plurality of attached toe separators, each of which is to be positioned between the toes and fastened in place on the top on a wearer's foot so as to allow the toes to be separated and extend outside of the sock when the rest of the foot is inside the sock. The full front opening/closure and toe separators allow for easy removal of the sock so as not to disturb the pedicure when the sock is removed.

3 Claims, 9 Drawing Sheets

(56) References Cited

U.S. PATENT DOCUMENTS

| | | | | |
|---|---|---|---|---|
| 2009/0178178 | A1* | 7/2009 | Nemcik | A41B 11/004 2/239 |
| 2010/0095434 | A1* | 4/2010 | Stuart | A41B 11/008 2/240 |

* cited by examiner

OPEN FRONT PEDICURE SOCK

BACKGROUND OF THE INVENTION

The present invention relates to pedicure socks that slide on allowing a user to keep his/her feet warm while toe nails are being polished and while they are drying and, at the same time, keep the toe nails separated so that the polish is not marred while it is drying.

While such pedicure devices may offer the ability to keep the user's foot warm to allow the user to walk outside in cold weather, or, even, to allow the user to be comfortable in a pedicure salon during the winter months when exposed feet are likely to be cold, a principal drawback to the above described pedicure devices is that in order to remove the device it must slide over the fresh pedicure. Since the fresh polish is likely to be marred and the sock may be stained or coated by the polish requiring the use of solvents to remove the polish from the sock, risking ruining the shoe or sock by application of the solvent.

In view of the above, it would be preferable that the toe nails are not touched by the sock upon removal however, there are no socks of this type that could be advantageously used as a pedicure device.

Segovia, U.S. Pat. No. 4,181,982, shows a stocking with a convertible toe opening so that the toes can be left exposed. Additionally, Schwab, U.S. Pat. No. 3,329,972, shows an infant's bootie which has a convertible toe construction allowing the toes to be exposed. Five toes are exposed in the stocking or sock of Pugliatti, U.S. Pat. No. 5,623,734. The primary drawback of these socks or is that in order to remove the sock after the pedicure it must be slid past the fresh manicure. The polish on the toe nails could be marred by adjacent toes or toe nails, and polish could rub off on the skin of the toes requiring the use of solvent to remove the polish. Another problem in the U.S. Pat. No. 5,623,734 is that the toe sleeves rest very close to the nail and seem more suited for longer toes. Thus, the polish on the toe nails could be marred by adjacent sleeves on the socks.

Other socks or stockings may separate the toes, but keep them covered while leaving other parts of the foot exposed. These too must slide over the pedicure in order to remove the device and, thus, are unacceptable as pedicure devices that will protect the pedicure and keep the feet warm, since they offer the same problems for freshly painted toe nails as do conventional socks or shoes. Patents on this type of sock or stocking include Craighead, U.S. Pat. No. 1,308,483, Bosworth, and U.S. Pat. No. 715,543.

Still other socks or stockings may have an open design that leaves the toes exposed. These too must slide over the pedicure in order to remove the device and, thus, are unacceptable as pedicure devices that will protect the pedicure and keep the feet warm, since they offer the same problems for freshly painted toe nails as do conventional socks or shoes. Additionally these socks offer no options to separate the toes and tend to slide when one walks because there is nothing between the toes to prevent slippage. An example Patents on this type of sock or stocking is Rosenberg, U.S. Pat. No. 5,749,100

Hedges, U.S. Pat. No. 1,798,201 refers to using socks or stockings which separate the five toes and enclose three out of the five toes. Two of the five toes are left uncovered so that there is less material between the toes to avoid excessive chafing. However, the Hedges sock or stocking offers the same problems when used as a pedicure device as do stockings or socks which enclose all of the toes and must slide over the pedicure in order to remove the device.

Baehr, U.S. Pat. No. 5,054,129, refers to a garment which exposes the toes and may separate the smallest toe and the largest toe from the other toes. It is unsuitable as a pedicure device because it does not separate each toe one from the other, and because its manner of separation only serves to divide the toes at their respective bases such that the tops of the toes, where the toenails are located, are not separated one from the other. Thus, the fresh polish applied during the pedicure can be easily marred by adjacent toes or toe nails. Additionally this devices is a much more open design and leaves a great deal of the foot exposed to the elements.

Pugliatti, U.S. Pat. No. 5,623,734 refers to a sock or stocking having an open stalls in FIG. 4. However, it does not appear that shorter toes can fit through these stalls and remain uncovered. Even if the slits were adjustable for any length toe, the Patent does not offer a way to prevent the garment material from slipping up and covering over at least a portion of the toe nail after it has been pulled down beneath the toe nail, thus, risking damage both to the polish and the garment.

Hearn, U.S. Pat. No. 1,999,929, refers to hosiery with strips or straps between each toe. However, the strips between the toes in Hearn are very thin and only serve to divide the toes at the base of each toe, such that the tops of each toe, where the toe nail is located, would be in contact with each other. When the tops of the toes are in contact with each other, fresh polish can easily be marred by adjacent toes and/or toe nails.

U.S. Pat. No. 6,704,941 B1 refers to hosiery in which the toes are exposed and each toe is separately encircled by the hosiery for dividing each toe one from the other. However, because of the fitted glove like design that captures each toes polish may be easily marred by adjacent toes and/or toe nails upon removal of the device. Additionally, this design is more suited for individuals with long toes as the toe sleeves bunch and gather at the top of the to thereby permitting further risk to the pedicure.

None of the pedicure devices or hosiery discussed above are designed to separate the toes, to be easily removed without sliding the device over the fresh pedicure to protect fresh polish on the toe nails and, provide ample covering to keep the foot warm, all at the same time

SUMMARY OF THE INVENTION

It is an object of the present invention to overcome the drawbacks of the prior art.

It is a further object of the present invention to provide a pedicure sock which can separate the toes, where the toe nails are located, to avoid damage to fresh polish and to make it easier to perform a pedicure.

It is a still further object of the present invention to provide a pedicure sock which can be worn during and/or after a pedicure to keep the user's foot warm.

It is yet a still further object of the present invention to provide a pedicure sock which allows access to a user's toe nails during a pedicure.

It is a still further object of the present invention to provide a pedicure sock which is capable of keeping the user's foot warm and keeping the user's toes separated to prevent damage to the polish applied during a pedicure and to prevent damage to the polish upon removal of the sock The present invention is a pedicure sock for wearing in cold weather before, during and/or after a pedicure. The sock is substantially tubular shaped and has thick separators that fit between each toe, to prevent each toe, where the toe nails are located, from contacting each other, and is designed for easy removal The present invention meets the needs presented above by including thick toe separators, a split front opening that runs the full length of the sock and a plurality of padded dividers attached to and extends along the bottom perimeter of the open toe section The present invention comprises a body that opens down the center including a leg portion, an ankle portion, heel portion and foot portion. Toe separators are attached to and extend away from the foot portion such that each one of a plurality of toes is decided and separated by the attached feature. Each of the separators has a hook and loop attachment point that attached to the top portion of the sock. Each of a plurality of dividers is attached to and extends along the bottom perimeter of the open toe section and provides added comfort warmth and separation during and after the pedicure and ensures that the sock remains in place on the foot and does not unwontedly slide over toenails.

There has thus been outlined, rather broadly, the more important features of the invention in order that the detailed description thereof that follows may be better understood, and in order that the present contribution to the art may be better appreciated. There are additional features of-the invention that will be described hereinafter and which will form the subject matter of the claims appended hereto.

The objects of the invention, along with the various features of novelty which characterize the invention, are pointed out with particularity in the claims annexed to and forming a part of this disclosure. The above and other objects, features and advantages of the invention will become readily apparent from the following detailed description thereof which is to be read in connection with the accompanying drawings.

DETAILED DESCRIPTION

Figure 1:
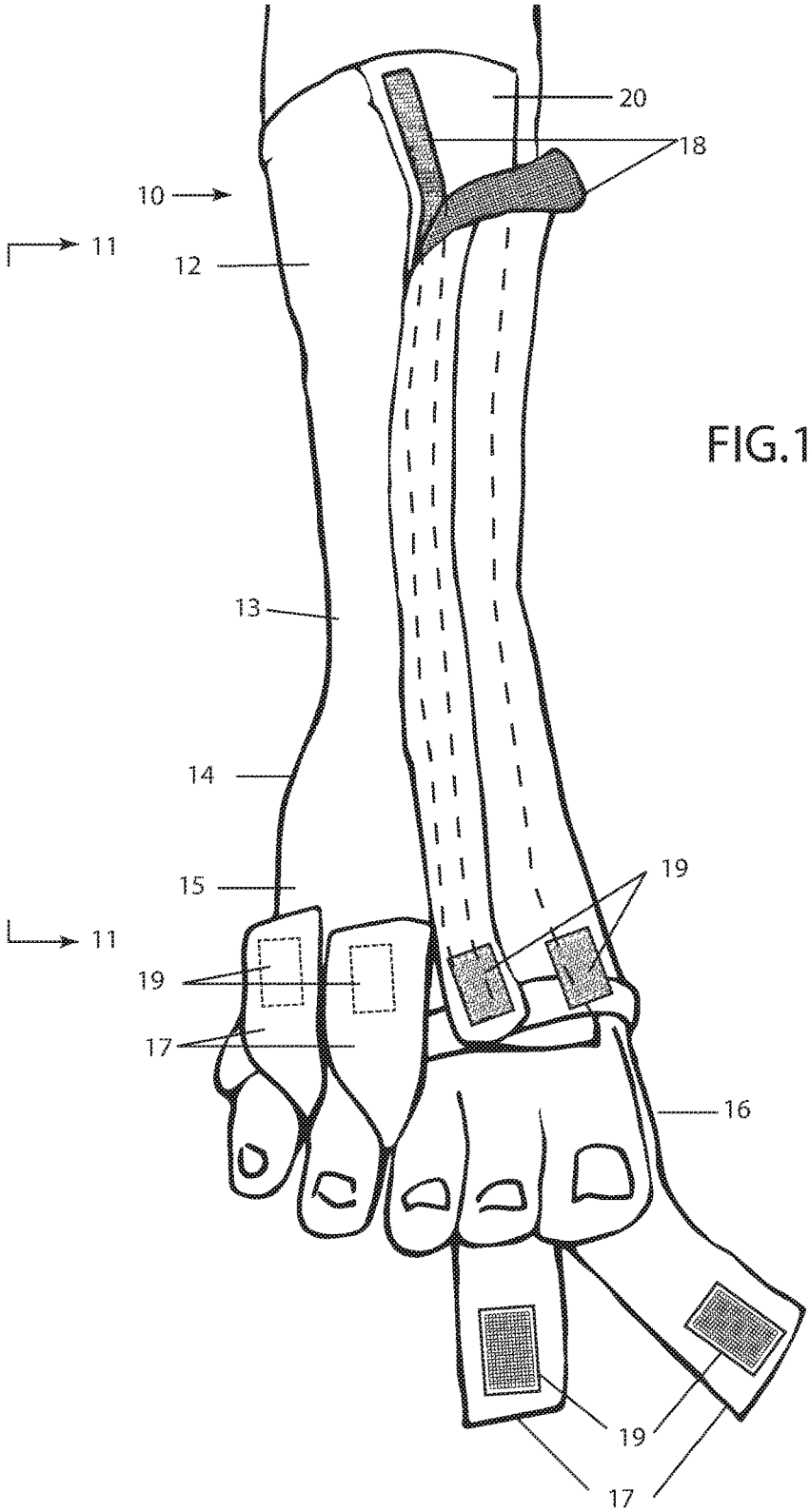
FIG. 1 is a topside front perspective view of a sock shown in FIG. 1 mounted on the left foot of a user, and showing two separators and the sock body partially open and unfolded revealing hook and loop fasteners for the toe separators and the full front opening

The present invention provides a pedicure sock that is capable of retaining moisture and keeping the feet warm during the cold seasons. Further the pedicure sock according to the present invention provides a means to preserve the polished look of a new pedicure without the need of flimsy flip flops or uncomfortable toe dividers. The article of footwear of the present invention allows the user to wear one article that exposes the toes while protecting and warming the remainder of the foot, ankle, and calf. The article could then be worn before, during, and after a pedicure. The present invention allows the user to wear traditional flip flops The pedicure sock according to the present invention retains moisturizing agents applied to the foot during the pedicure and may also be used as a protector that could be worn in colder seasons. The key feature of this invention is that it can be easily removed without smudging a fresh pedicure.

Referring to the drawings The open front pedicure sock 10 embodying the principles of and concepts of the present invention will be described as best illustrated in FIGS. 1, 2, 3,4, 5, 6, 7, 8, and 9. The open front pedicure sock 10 generally includes a body 11 (including a leg portion 12, and ankle portion 13, heel portion 14 and foot portion 15), a thick padding beneath the ball of foot 16 and toe separating tabs 17. The body 11 preferably comprises a soft resiliently stretchable cloth material which may be, but not limited to any conventional material used for socks such as cotton, nylon, polyester, spandex, or mixtures of these or other conventional sock materials. The body 11 forms a sock having an end to which is attached a plurality of plush toe separating tabs 17. The open front pedicure sock 10 according to present invention also is a durable, soft and are designed to be worn in colder climates or seasons.

Figure 2:
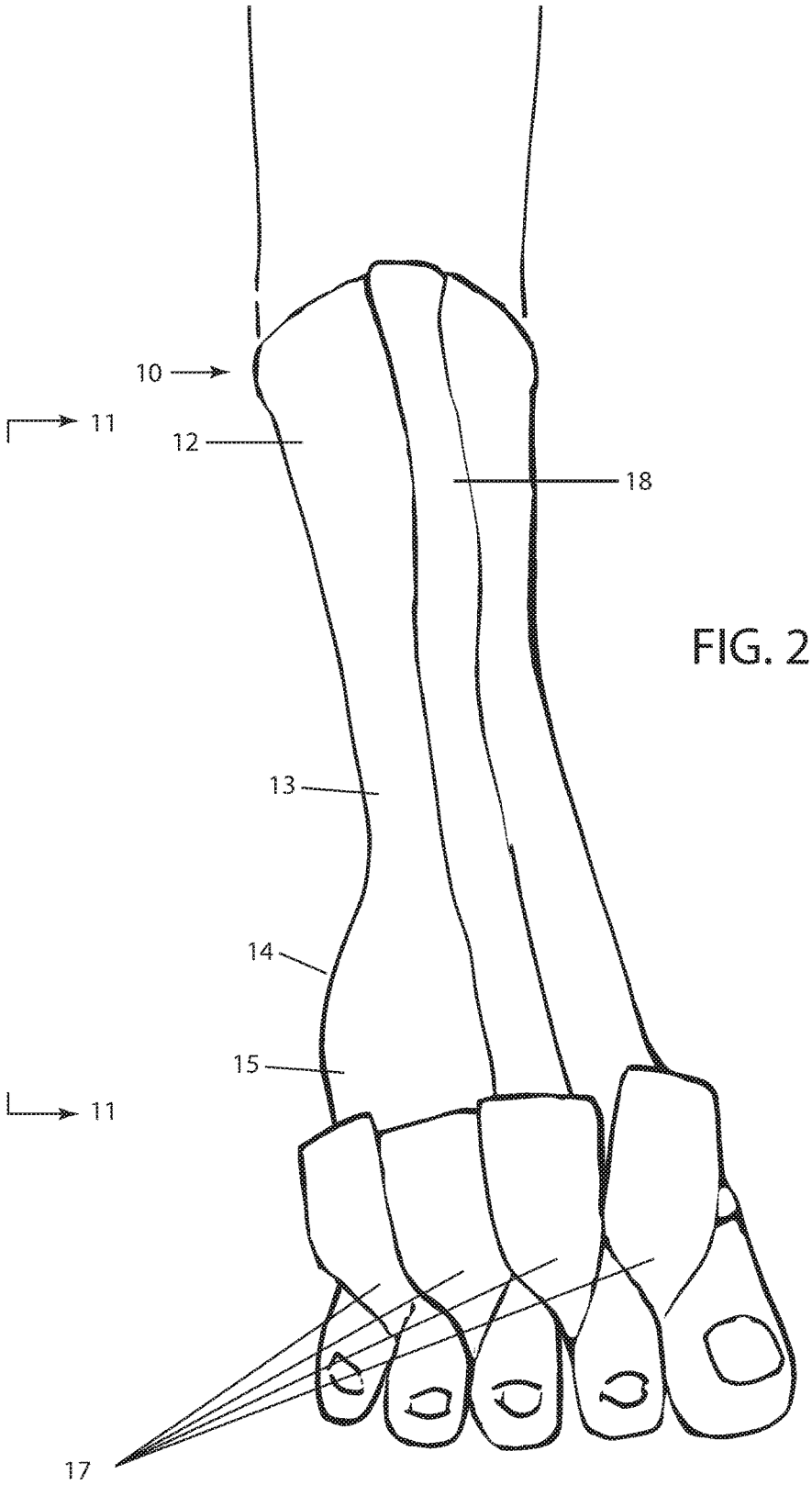
FIG. 2 is a topside front perspective view of sock mounted on the left foot of a user.
Figure 3:
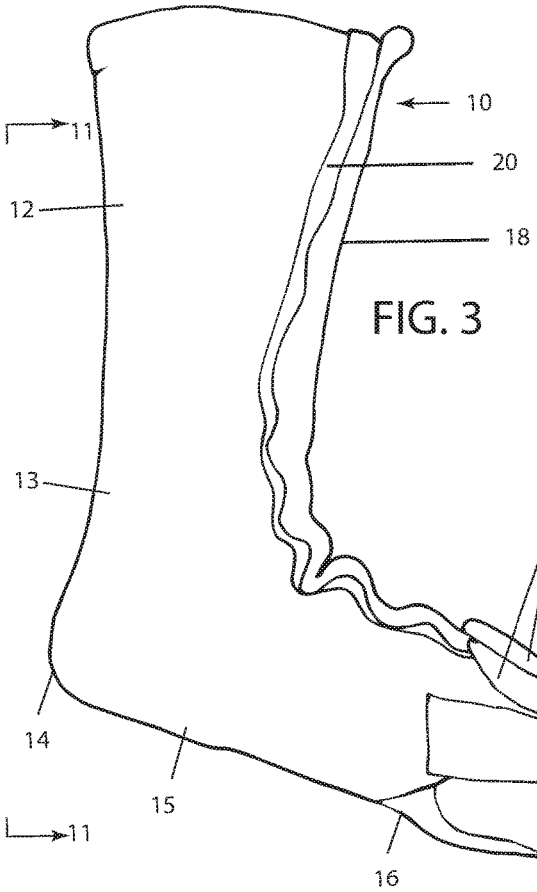
FIG. 3 is an inside and top elevational view of the sock shown in FIG. 1 mounted on the left foot of a user.
Figure 4:
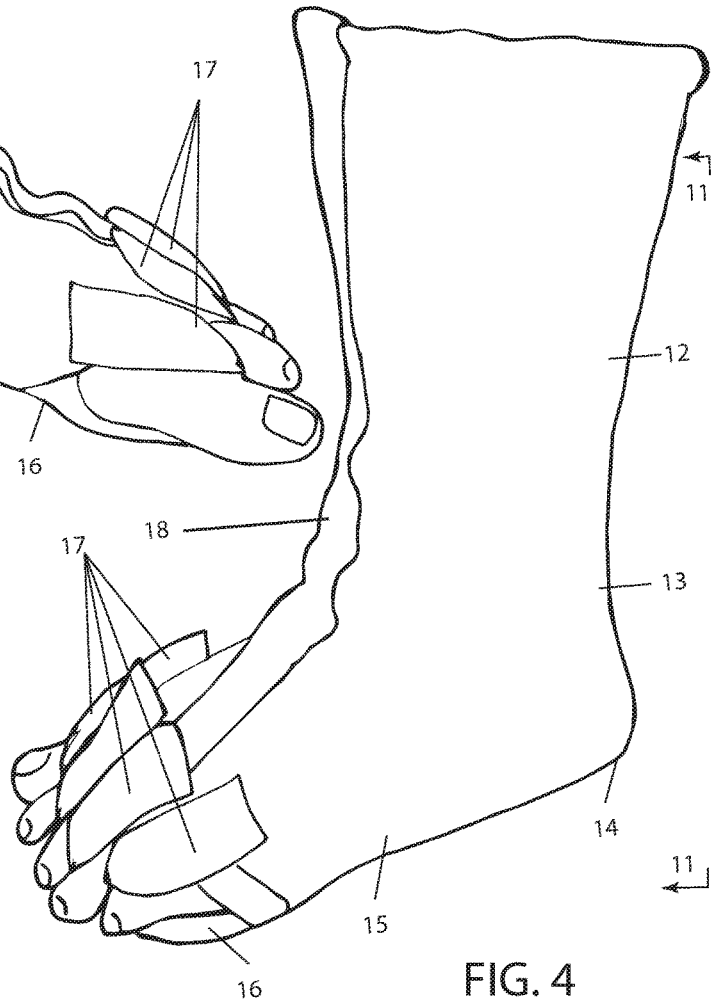
FIG. 4 is an outside and top elevational view of the sock shown in FIG. 1 mounted on the left foot of a user.

The toe separating tabs 17 extend away from the foot portion 15 such that each one of a plurality of toes is separated by the toe separating tabs 17. In use, the device is positioned over a foot and the toes extended through and outward such that each of the plush toe separating tabs 17 fits between the toes. Repositionable toe separating tabs 17 secured with but not to be limited to hook and loop fasteners hold the toe separating tabs 17 in place and serves to separate the toes. Each of the repositionable toe separating tabs 17 extends away from the body 11. The open front pedicure sock 10 is worn to keep the foot of the wearer clean and warm while receiving a pedicure as well as when walking to or from the pedicure. As depicted in FIG. 1 and FIG. 2 the toe separating tabs 17 are placed between the toes. Hook and loop fasteners 19 are positioned on the top side of The open front pedicure sock 10 and at the ends of the toe separating tabs 17 and provide another comfort feature according to the present invention. A person's toes are exposed at the toe end of The open front pedicure sock 10. The exposed toenails therefore are separated by the toe separating tabs 17 and may therefore air dry as when a conventional toe divider is used.

The open front pedicure sock 10 is placed over a foot in FIG. 1 and FIG. 2. Full front closure 18 secured with but not to be limited to hook and loop fasteners as in FIG. 9 down the center of the invention provides a means to tighten and secure The open front pedicure sock 10 onto the foot and also allows the user to remove the article without smudging the fresh pedicure. When the full front closure 18 is completely opened as in FIG. 6 and FIG. 7 the device is easily removed without passing over freshly painted toes.

The open front pedicure sock 10 according to the present invention provides a means to extend the benefits of a pedicure by keeping in moisture that is often lost when putting on flip flops following a pedicure. The open front pedicure sock 10 also provides a means for a user to keep the feet clean and warm until they are in a warmer environment. Further, The open front pedicure sock 10 is aesthetically pleasing and attractive and provides the user with an added luxury to the pedicure spa experience.

Referring to FIG. 1 The open front pedicure sock 10 placed over a foot shows the toe separating tabs 17 full front hook and loop closure 18 series of hook and loop repositionable toe dividers 17 partially open to reveal the hook and loop closures As depicted in FIG. 1 the toe separating tabs 17 are connected to a thick padding beneath the ball of foot 16 and may be made of but not limited to a plush felt-type material where they're sewn with the hosiery and connects to the base of The open front pedicure sock 10.

Figure 5:
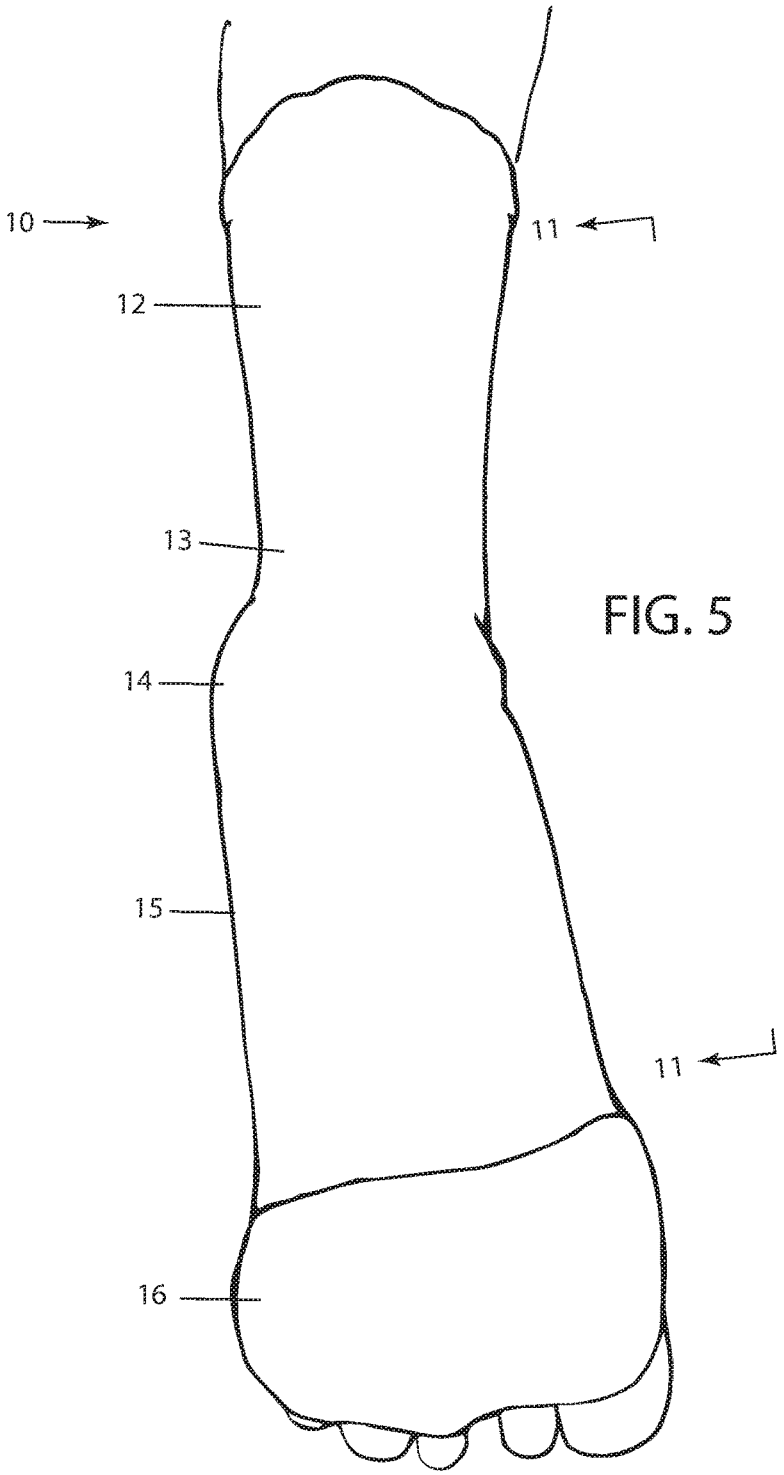
FIG. 5 is a rear and bottom view of sock shown in FIG. 1 mounted on the right foot of a user.
Figure 6:
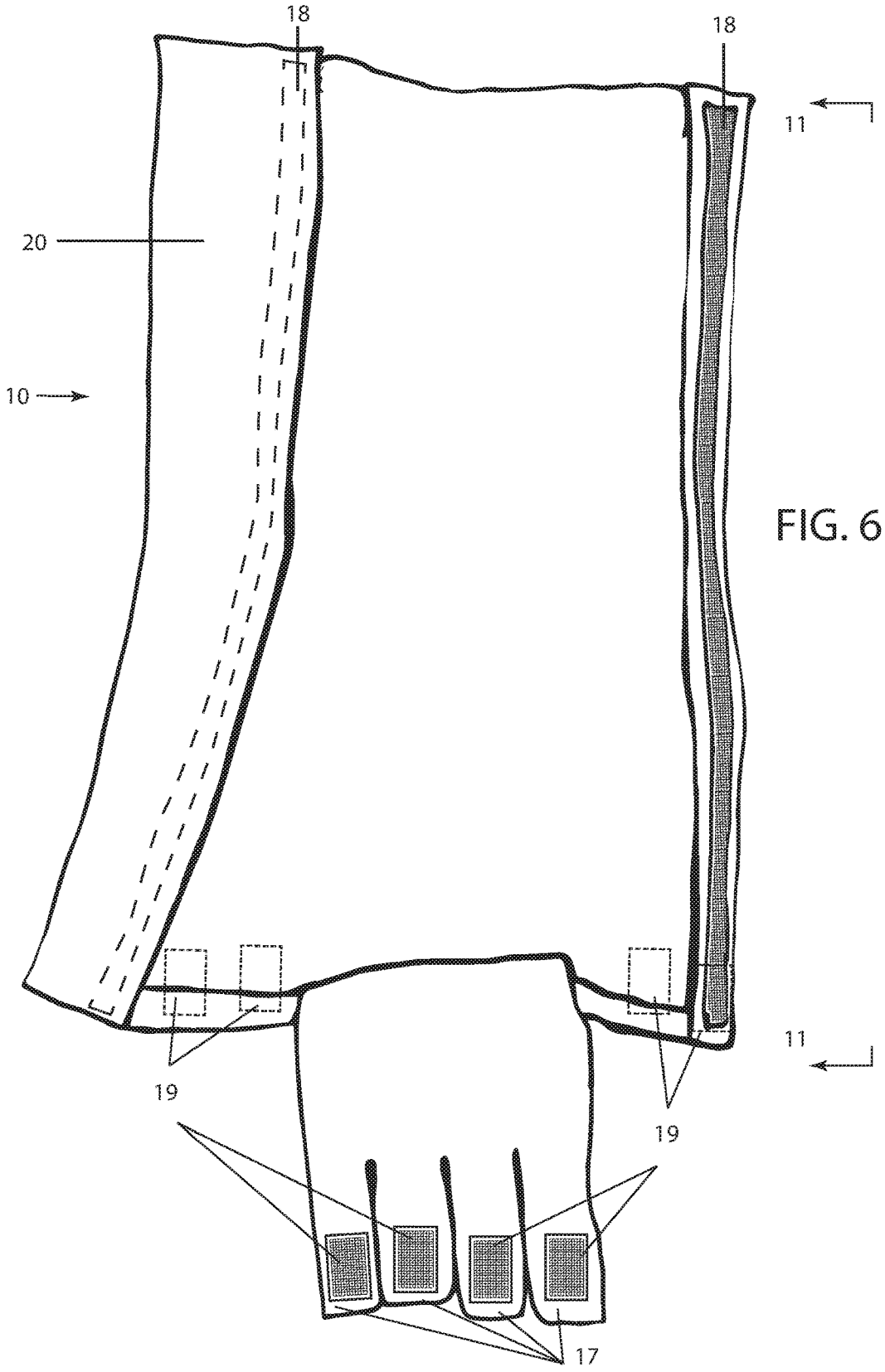
FIG. 6 is an overhead view of the sock shown in FIG. 1 but without the foot of the user and showing four separators and the entire sock body open and unfolded revealing the inside of the sock, the hook and loop fasteners for the toe separators and the full front opening
Figure 7:
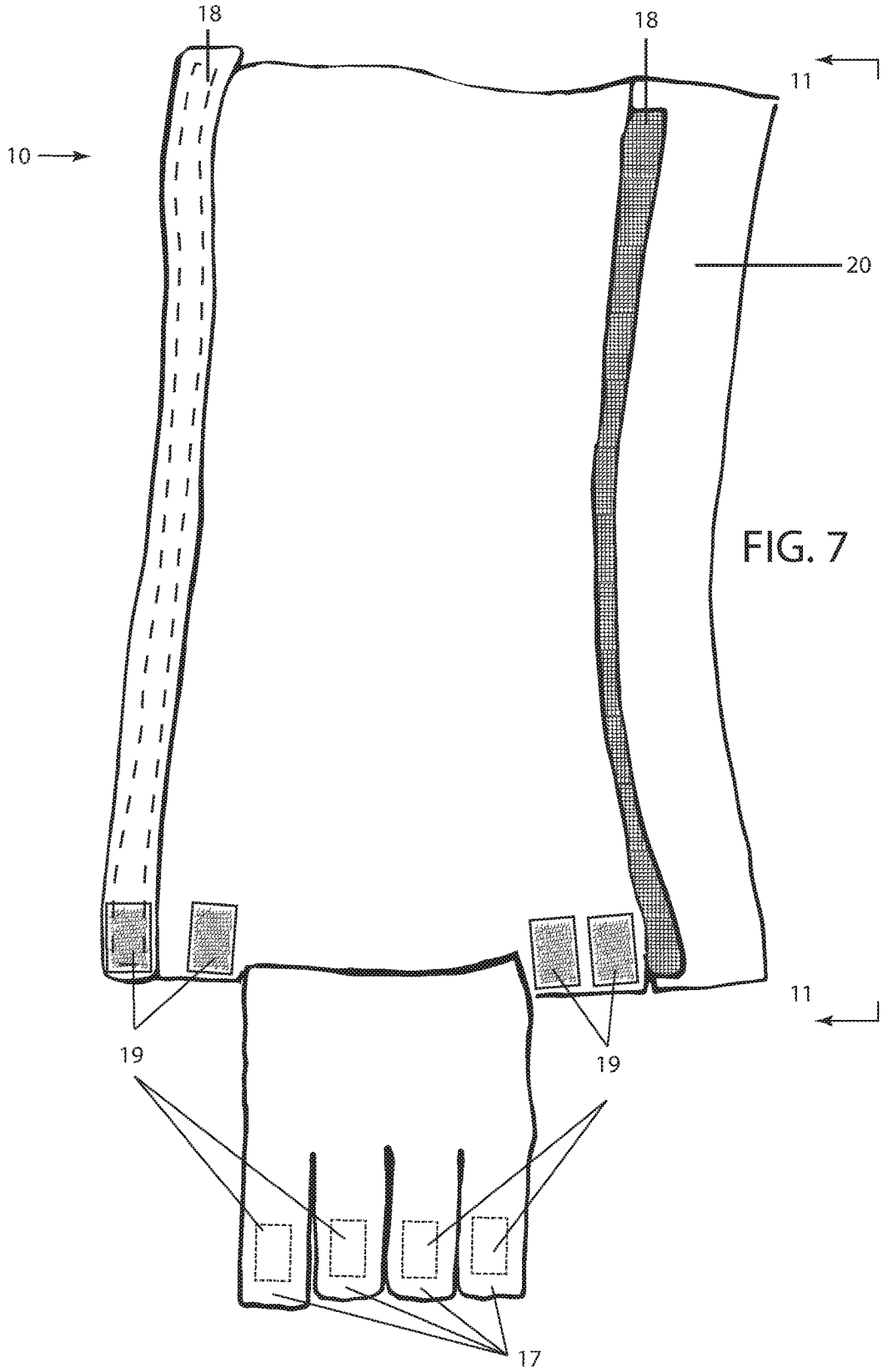
FIG. 7 is an overhead view of the sock shown in FIG. 1 but without the foot of the user and showing four separators and the entire sock body open and unfolded revealing the back side of the sock, the hook and loop fasteners for the toe separators and the full front opening
Figure 8:
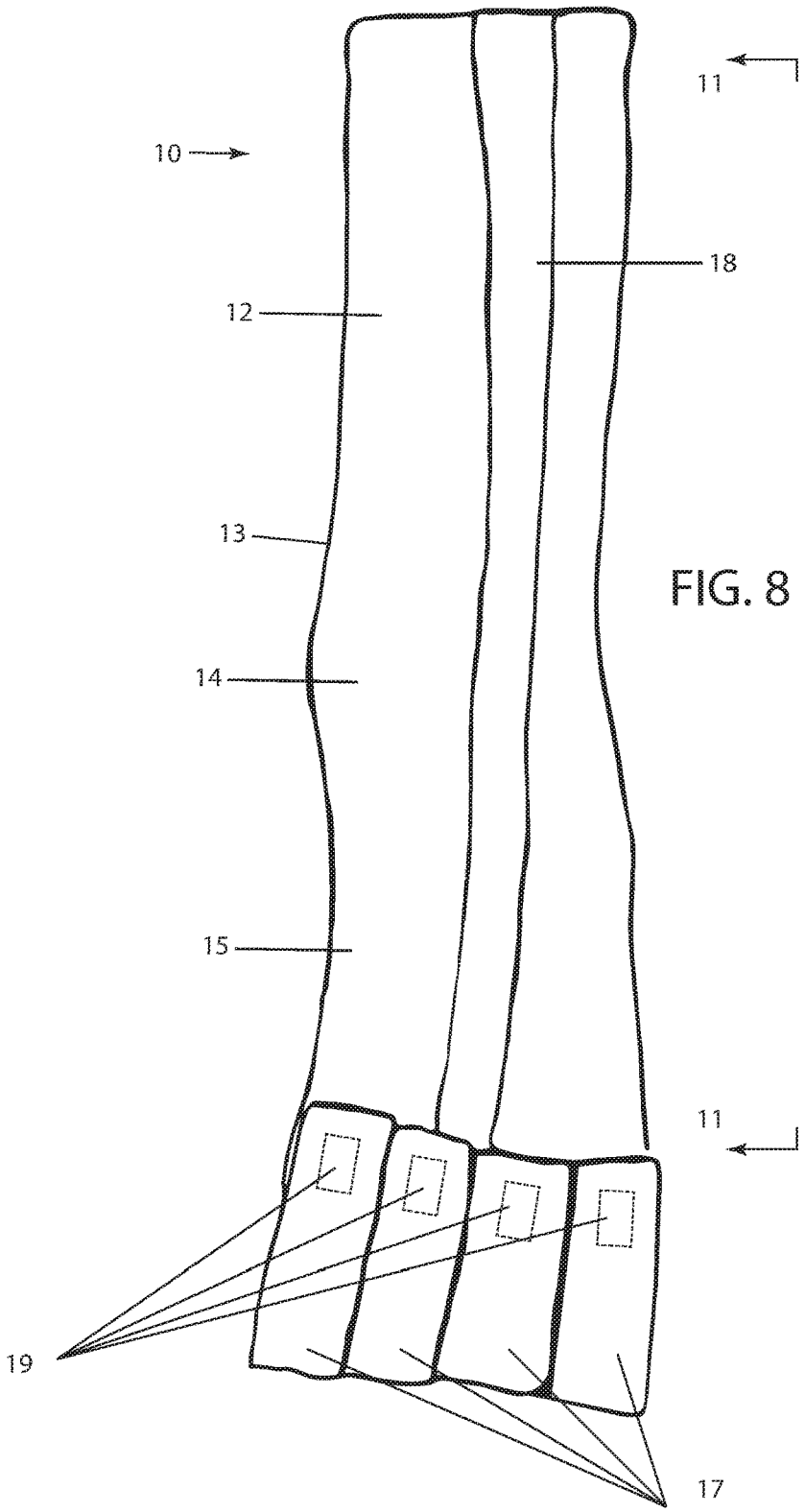
FIG. 8 is a front overhead view of the sock shown in FIG. 1 but without the foot of the user and showing four separators in place
Figure 9:
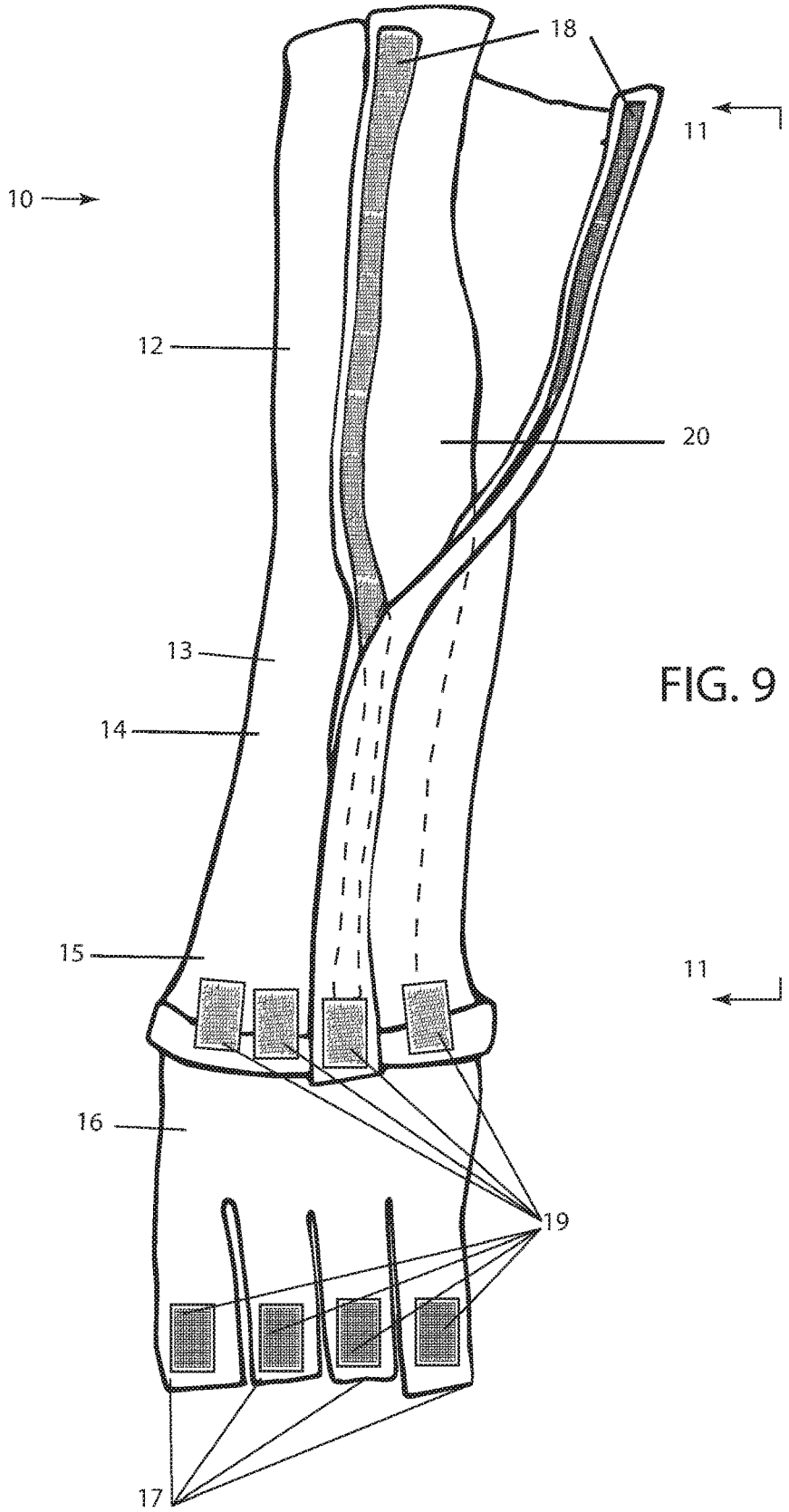
FIG. 9 is a front overhead view of the sock shown in FIG. 1 but without the foot of the user and showing four separators and the sock body partially open and unfolded revealing hook and loop fasteners for the toe separators and the full front opening
Figure 10:
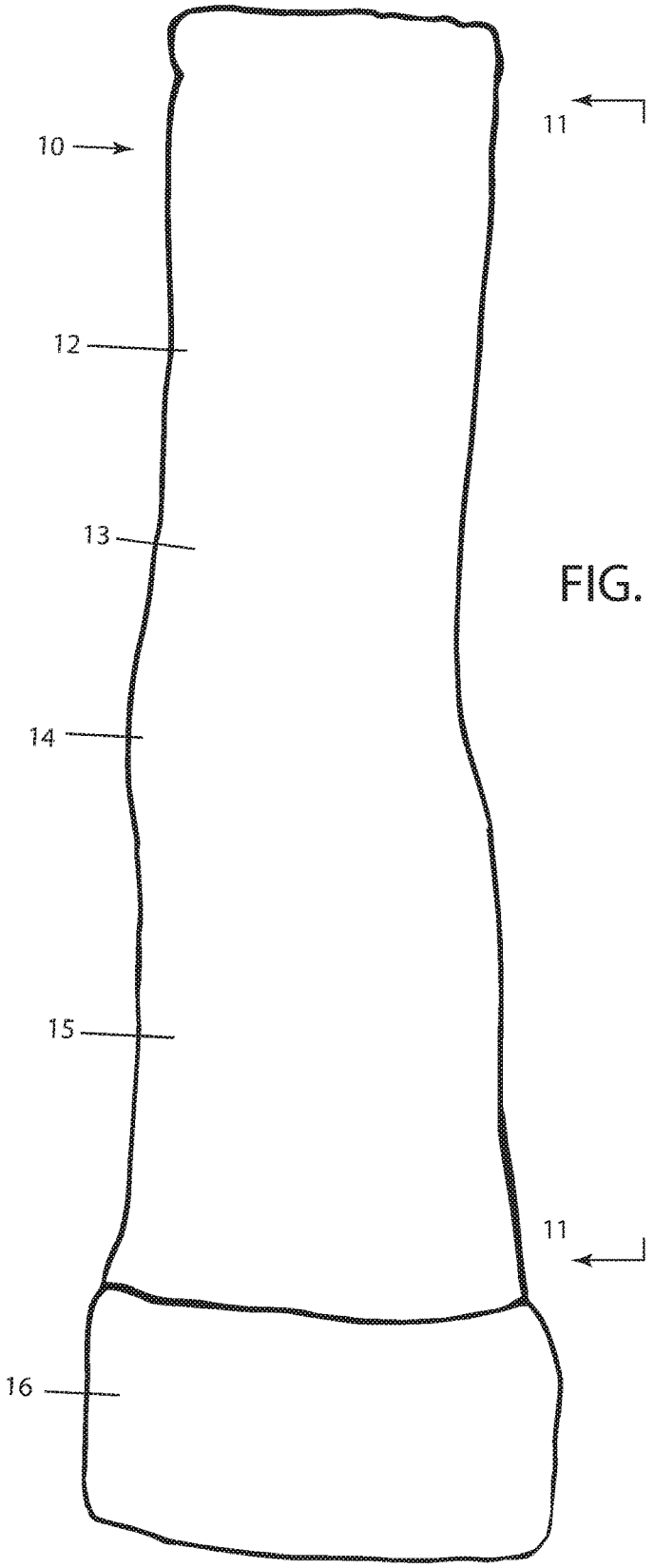
FIG. 10 is a rear overhead view of the sock shown in FIG. 1 but without the foot of the user with four separators in place

Referring to FIG. 5 and FIG. 10 the thick padding beneath the ball of foot 16 provides an added level of comfort an warmth. The toe separating tabs 17 and thick padding beneath the ball of foot 16 are designed to cushion the foot and separate the toes of the user. Referring to FIG. 1 and FIG. 6 and FIG. 9 The full front closure 18 is backed with a comfort strip 20 that may be made of but not limited to a plush felt-type material where they're sewn with the hosiery.

The invention has been shown and described in what is considered to be the most practical and preferred embodiments. It is recognized, however, that departures may be made there from within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A sock comprising:

a body comprising a top leg portion, an ankle portion, a heel portion, and a bottom toe portion;

a front opening extending an entire length of the body from the top leg portion to the bottom toe portion;

a front closure for closing the front opening to secure the sock onto a user's foot, whereby when the front opening is closed by the front closure the toe portion creates a toe opening configured to surround the user's foot while exposing toes of the user; and a ball cushion secured to a bottom end of the bottom toe portion and configured to be positioned beneath a ball of the user's foot, the ball cushion comprising a plurality of toe separating tabs, each toe separating tab comprising a fastener at a bottom end thereof, each fastener being detachably secured to a corresponding fastener on the bottom toe portion for separating the user's toes during a pedicure.

2. The sock of claim 1, wherein the body comprises a soft resiliently stretchable cloth material.

3. The sock of claim 1, wherein the fasteners on the toe separating tabs and the fasteners on the bottom toe portion comprise hook and look fasteners.

* * * * *